United States Patent [19]

Gautraud

[11] Patent Number: 4,817,947

[45] Date of Patent: Apr. 4, 1989

[54] METHOD OF PLAYING A BOWLING GAME

[75] Inventor: Michael G. Gautraud, Muskegon, Mich.

[73] Assignee: Brunswick Corporation, Skokie, Ill.

[21] Appl. No.: 118,247

[22] Filed: Nov. 9, 1987

[51] Int. Cl.[4] ..... A63D 5/00

[52] U.S. Cl. ..... 273/37

[58] Field of Search ..... 273/37, 54 R, 54 C, 273/54 D

[56] References Cited

U.S. PATENT DOCUMENTS

| | | | |
|---|---|---|---|
| 3,153,538 | 10/1964 | Rogers | 273/43 D |
| 3,212,780 | 10/1965 | Jewell | 273/54 C |
| 3,529,824 | 9/1970 | Walch | 273/54 R |
| 4,597,575 | 7/1986 | Kosof | 273/37 |

FOREIGN PATENT DOCUMENTS

| | | | |
|---|---|---|---|
| 809541 | 4/1969 | Canada | 273/54 C |

*Primary Examiner*—Anton O. Oechsle

*Attorney, Agent, or Firm*—Wood, Dalton, Phillips Mason & Rowe

[57] ABSTRACT

A method of playing a bowling game in which players are allowed at least one ball to knock down pins in each of a plurality of frames. A handicap is determined for each player of the game. A handicap pin setup is selected for each player for each frame commensurate with the respective player's handicap. Each player is required to deliver at least one ball in each frame. The number of pins knocked down by each player in each frame is counted to determine a score for each player for each frame. Each player's frame score is recorded as determined by the counting, and each player's frame scores are added to determine the player's total score for the game. The players' game scores are compared to determine the winner of the game.

24 Claims, 1 Drawing Sheet

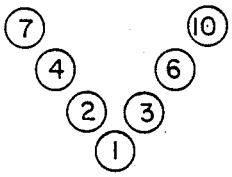
FIG. 1
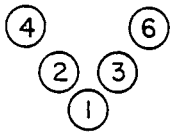
FIG. 2
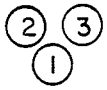
FIG. 3
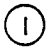
FIG. 4
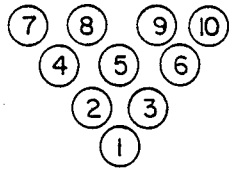
FIG. 5
| NAME | 1 | 2 | 3 | 4 | 5 | 6 | 7 | 8 | 9 | 10 | TOTAL |
|---|---|---|---|---|---|---|---|---|---|---|---|
| 1 JONES | 2 X<br>4 | 1 /<br>6 | 1 / | | | | | | | | |
| 2 SMITH | 1 /<br>2 | 1 /<br>4 | 1 / | | | | | | | | |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |
FIG. 6

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by players in turn delivering balls at a triangulated ten-pin setup. The pins are numbered in numerical order from "1" to "10" beginning at the forward apex of the triangulated array of pins. The apex pin is numbered "1"; the next row of two pins is numbered "2" and "3", beginning at the left; the next row is numbered "4", "5" and "6", beginning at the left; and the last or back row is numbered "7", "8" "9" and "10", again beginning at the left. In conventional bowling games, a "strike" (knocking down all pins on a first ball) or a "spare" (knocking down all pins on two balls) require the addition of a pin count for pins knocked down in subsequent frames to the pin counts in earlier frames. Specifically, the number of pins knocked down by a player on the next two balls are added to any frame score where that player has recorded a strike, and the number of pins knocked down by a respective player on the next one ball are added to any frame score where that player has recorded a spare. This scoring system carries forward throughout all frames of a game.

It is quite difficult to maintain interest in bowling games wherein there is a range of skill between the respective players in the game. This is one of the main reasons why certain individuals lose interest and hope and, ultimately, give up on the sport. For instance, one member of a family may be considerably better and/or have acquired greater skills than another member of a family. It is quite difficult to provide a family fun game with such disparingly different levels of skill.

Heretofore, different skill levels have been accommodated by handicapping the different players. In other words, one player of a game of lesser skill may be "spotted" a given score value before a game even begins. However, even this attempt to accommodate different levels of skill for the players does not solve the problem because all of the players of the game still are rolling balls at the same pin setup and the level of play of a more skilled or experienced player continues to predominate.

There is a definite need for new methods of playing a bowling game which increase and enhance the public interest in the sport. This invention generally is directed to satisfying these needs and, particularly, to providing a new method of playing a bowling game wherein different players of different skill levels and/or experience can compete together in an interesting and satisfying game.

SUMMARY OF THE INVENTION

An object of the invention, therefore, is to provide a new method of playing a bowling game in which players are allowed at least one ball to knock down pins in each of a plurality of frames.

The method generally includes determining a handicap for each player of the game, and selecting a handicap pin setup for each player for each frame commensurate with the respective player's handicap. Thereafter, each player is required to deliver at least one ball in each of the frames. The number of pins knocked down by each player is counted in each frame, to determine a score for each player for each frame. Each player's frame score is recorded as determined by the counting. Each player's frame scores are added to determine the player's total score for the game. The players' game scores are compared to determine the winner of the game.

With the above-described new method of playing a bowling game, conventional scoring systems can be employed, such as strikes and spares. In other words, the number of pins knocked down by a respective player on the next two balls are added to any frame score where that player has recorded a strike. The number of pins knocked down by a respective player on the next one ball are added to any frame score where that player has recorded a spare. The invention contemplates a novel method of determining a strike or a spare. For instance, a strike may be recorded for any player knocking down a first given number of pins on a first ball in any frame. A spare is recorded for any player knocking down a second given number of pins on the first ball in any frame. As an example, the invention contemplates a game in which each player is limited to delivering only one ball in each frame. With the pin setups being selectively handicapped for the respective players, a strike may be recorded if a player knocks down two pins with his one ball. A spare may be recorded if a player knocks down one pin with this ball.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a representation of a given handicap pin setup of seven pins, such as for a "novice";

FIG. 2 is a representation of a handicap pin setup of five pins, such as for a "beginner";

FIG. 3 is a representation of a handicap pin setup of three pins, such as for an "amateur";

FIG. 4 is a representation of a handicap pin setup of one pin, such as for a "veteran";

FIG. 5 is a representation of a handicap pin setup for a "professional" and comprises a full ten-pin setup; and FIG. 6 is a conventional bowling game score sheet which might be used in recording the scores of the game.

DETAILED DESCRIPTION OF THE PREFERRED EMBODIMENT

As stated above, conventional bowling games can be quite difficult for a novice or beginning bowler to compete regularly with a more experienced or skilled bowler when using a conventional ten-pin frame setup. This is primarily due to the fact that a ten-pin frame setup includes a number of "interior" pins which make a strike more difficult. This invention is directed to a method of playing a bowling game in which players are allowed at least one ball to knock down pins in each of a plurality of frames, wherein the frames comprise differing pin setups for differing players depending upon their skill levels and, particularly eliminating interior pins for lower level bowlers.

First of all, the method of this invention contemplates determining a handicap for each player of a game. This can be accomplished in a variety of ways. For instance, all players may start out at a given level and their playing "status" be determined as play proceeds during games for handicapping in subsequent games. Alternatively, all players can be required to deliver balls in a given number of frames, such as four or five frames, of a given pin setup and then determine their skill levels. In fact, an entire game could be played to determine the players' status. On the other hand, players may already have established averages as determined by prior playing experience. The latter is common for most bowlers who participate in bowling leagues wherein their score averages often are recorded. Of course, the game of this invention contemplates play in which all players of a game begin play at the same level or status if they are, in fact, substantially equal in skill and/or experience.

To enhance play, the players would be given a particular "status" as determined by any of the procedures outlined above. For instance, a "novice" player might have a score average of less than 100. A "beginner" player may have an average of above 100. An "amateur" player may have an average of above 150. A "veteran" player may have an average of above 165. A "professional" player may have an average of above 180. In essence, this determines the handicap for each player of the game.

The next step is to select a handicap pin setup for each player for each frame commensurate with the respective player's handicap. To this end, reference is made to FIGS. 1–5. FIG. 1 represents a seven-pin setup for a "novice" player, wherein it can be seen that the interior pins of a conventional ten-pin setup have been eliminated. FIG. 2 shows a five-pin setup for a "beginner" player. FIG. 3 shows a three-pin setup for an "amateur" player. FIG. 4 shows a one-pin setup for a "veteran" player. FIG. 5 shows a full ten-pin setup for a "professional" player. Therefore, the differing pin setups are commensurate with the status of the respective players as determined by one of the schemes described above.

Scoring can be carried out the same as a conventional bowling game, using strikes and spares. In other words, the number of pins knocked down by a respective player on the next two balls are added to any frame score where that player has recorded a strike, and the number of pins knocked down by a respective player on the next one ball are added to any frame score where that player has recorded a spare. However, with the nature of the pin setups illustrated in FIGS. 1–5, it would be desirable to limit each player to delivering only one ball in each frame. The counting of pins knocked down can be modified from conventional practice. For instance, if a player knocks down any two pins in his respective handicap pin setup, a strike would be recorded If a player knocks down only one pin in his respective handicap pin setup, a spare would be recorded. Of course, other schemes can be designed with the handicapped system of play of this invention. In addition, for a "veteran" player who must deliver his one ball at only one pin as depicted in FIG. 4, that player may be required to score a strike in each frame in order to have any carry-over score. In addition, a "professional" player who must deliver his one ball at a full ten-pin setup as depicted in FIG. 5, may be required to knock down all pins for a strike, as is conventional, and less than all of the pins for a spare.

Referring to FIG. 6, assume that a two-some of "Jones" and "Smith" are playing the game. By one of the schemes described above for determining players' handicaps, assume that Jones has been determined to have a "novice" status, and Smith has been determined to have a "beginner" status. Therefore, during play of the game, Jones will deliver his balls at frames having pin setups according to FIG. 1, and Smith will deliver balls at pin setups according to FIG. 2. As stated above, each player delivers only one ball in each frame. If the player knocks down any two pins, a strike is recorded and if the player knocks down only one pin, a spare is recorded.

Therefore, assume that, during the first turn of play for frame "1", Jones delivers his one ball and knocks down the "6" and "10" pins. Jones would be awarded a strike, as indicated. In Smith's first turn, he delivers his one ball and knocks down only the "4" pin. Jones would be awarded a spare. The number of pins also can be recorded, as shown in FIG. 6.

During the next two frames or turns of play, Jones knocks down only one pin in each frame. With the conventional "strike-spare" scoring system, the pins in Jones' second and third frames would be added to the first frame for a total of "4" for the first frame. Only the score for the third frame would be added to the second frame for a score total of "6" through the two frames. Smith continues to score spares in the second and third frames, whereby only the number of pins knocked down in the immediately succeeding frame is added to the previous frame, whereby Smith has a score of "4" through the first two frames. This scoring scheme would continue throughout the entire game of ten frames, for instance.

As stated above, should a "veteran" (i.e. the pin setup of FIG. 4) or a "professional" (i.e. the pin setup of FIG. 5) be playing in the game, their scoring system might be different because of their types of pin setups. Since the veteran (FIG. 4) has only one pin to knock down, this more experienced player cannot ever score a spare and can only score strikes. The "professional" (FIG. 5) may be required to knock down all of the pins in order to score a strike and may also be precluded from scoring a spare, but in no instance can the professional have a carry-over addition of all of the pins he might possibly knock down because, of course, he has a full complement of a ten-pin setup.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed at least one ball to knock down pins in each of a plurality of frames, said method comprising:

(a) determining a handicap for each player of the game;

(b) selecting a handicapped pin setup for each player for each frame commensurate with the respective player's handicap;

(c) requiring each player to deliver at least one ball in each said frames;

(d) counting the number of pins knocked down by each player in each frame, for determining a score for each player for each frame;

(e) recording each player's frame score as a function of said counting;

(f) adding each player's frame score to determine said player's total score for the game; and (g) comparing the player's game scores to determine the winner of the game.

2. The method of claim 1 wherein a strike is recorded for any player knocking down a first given number of pins on a first ball in any frame.

3. The method of claim 2 wherein a spare is recorded for any player knocking down a second given number of pins on said first ball in any frame.

4. The method of claim 3 wherein the number of pins knocked down by a respective player on the next two balls are added to any frame score where that player has recorded a strike, and the number of pins knocked down by a respective player on the next one ball are added to any frame score where that player has recorded a spare.

5. The method of claim 1 wherein each player is limited to delivering only one ball in each frame.

6. The method of claim 1 wherein the selected pin setup for each respective player remains the same for all said frames.

7. The method of claim 1 wherein a first level handicapped pin setup comprises the "1", "2", "3", "4", "6", "7" and "10" pins.

8. The method of claim 7 wherein a second level handicapped pin setup comprises the "1", "2", "3", "4" and "6" pins.

9. The method of claim 8 wherein a third level handicapped pin setup comprises the "1", "2" and "3" pins.

10. The method of claim 9 wherein a strike is recorded for any player knocking down a first given number of pins on a first ball in any frame.

11. The method of claim 10 wherein a spare is recorded for any player knocking down a second given number of pins on said first ball in any frame.

12. The method of claim 9 wherein a fourth level handicapped pin setup comprises the "1" pin.

13. The method of claim 12 wherein a fifth level handicapped pin setup comprises a full ten-pin setup.

14. The method of claim 1 wherein each player's handicap is determined by requiring all players to play a predetermined number of frames of the same pin setups for all players before a game starts.

15. A method of playing a bowling game in which players are allowed at least one ball to knock down pins in each of a plurality of frames, said method comprising:

(a) determining a handicap for each player of the game:

(b) selecting a handicapped pin setup for each player for each frame commensurate with the respective player's handicap;

(c) requiring each player to deliver only one ball in each said frames;

(d) counting the number of pins knocked down by each player in each frame, for determining a score for each player for each frame;

(e) recording each player's frame score as a function of said counting, with a strike being recorded for any player knocking down a first given number of pins on said one ball in any frame and a spare being recorded for any player knocking down a second given number of pins on said one ball in any frame, the number of pins knocked down by a respective player on the next two balls being added to any frame score where that player has recorded a strike, and the number of pins knocked down by a respective player on the next one ball being added to any frame score where that player has recorded a spare;

(f) adding each player's frame score to determine said player's total score for the game; and (g) comparing the player's game scores to determine the winner of the game.

16. The method of claim 15 wherein the selected pin setup for each respective player remains the same for all said frames.

17. The method of claim 15 wherein a first level handicapped pin setup comprises the "1", "2", "3", "4", "6", "7" and "10" pins.

18. The method of claim 17 wherein a second level handicapped pin setup comprises the "1", "2", "3", "4" and "6" pins.

19. The method of claim 18 wherein a third level handicapped pin setup comprises the "1", "2" and "3" pins.

20. The method of claim 19 wherein a strike is recorded for any player knocking down a first given number of pins on a first ball in any frame.

21. The method of claim 20 wherein a spare is recorded for any player knocking down a second given number of pins on said first ball in an frame.

22. The method of claim 19 wherein a fourth level handicapped pin setup comprises the "1" pin.

23. The method of claim 22 wherein a fifth level handicapped pin setup comprises a full ten-pin setup.

24. The method of claim 15 wherein each player's handicap is determined by requiring all players to play a predetermined number of frames of the same pin setups for all players before a game starts.

* * * * *